United States Patent [19]

Kewin

[11] Patent Number: 4,858,762

[45] Date of Patent: Aug. 22, 1989

[54] PACKAGING FOR PAPER ROLLS (UNIFORM WRAP SYSTEM)

[76] Inventor: Daniel D. Kewin, 16 Dogwood Drive, Brantford, Ontario, Canada, N3R 1R3

[21] Appl. No.: 312,550

[22] Filed: Feb. 21, 1989

[51] Int. Cl.[4] ..... B65D 85/67

[52] U.S. Cl. ..... 206/414

[58] Field of Search ..... 206/414, 413, 407, 396, 206/389, 410

[56] References Cited

U.S. PATENT DOCUMENTS

| | | | |
|---|---|---|---|
| 298,562 | 5/1884 | Dunnell | 206/414 |
| 1,772,850 | 8/1930 | Wheldon | 206/414 |
| 4,505,387 | 3/1985 | Seto | 206/414 |
| 4,793,485 | 12/1988 | Bertolotti | 206/414 |

*Primary Examiner*—Joseph Man-Fu Moy

*Attorney, Agent, or Firm*—Robert F. Delbridge; Arne Fors

[57] ABSTRACT

A packaged roll of paper or other sheet material includes a roll of paper or other sheet material, a protective sheet of material wrapped around the circumference of the roll and having overlapping longitudinally-extending edge portions secured together. The protective sheet extends beyond the roll at opposite ends thereof to provide projecting protective sheet portions, and the projecting portion of the protective sheet at each end is crimped radially inwardly over the outer annular portion of the end of the roll. At least one header assembly at each end of the roll is located externally and/or internally of the crimped over projecting protective sheet portion, and at least one header assembly has a series of generally rectangular strips of material superposed one on top of the other in a star-like manner with central portions overlapping and secured together and shorter edges outermost and adjacent but within the periphery of the roll. The overlapping central portions of the header assembly strips are located within the outer annular portion of the end of the roll over which the crimped over projecting protective sheet portion extends.

6 Claims, 4 Drawing Sheets

PACKAGING FOR PAPER ROLLS (UNIFORM WRAP SYSTEM)

Figure 1:
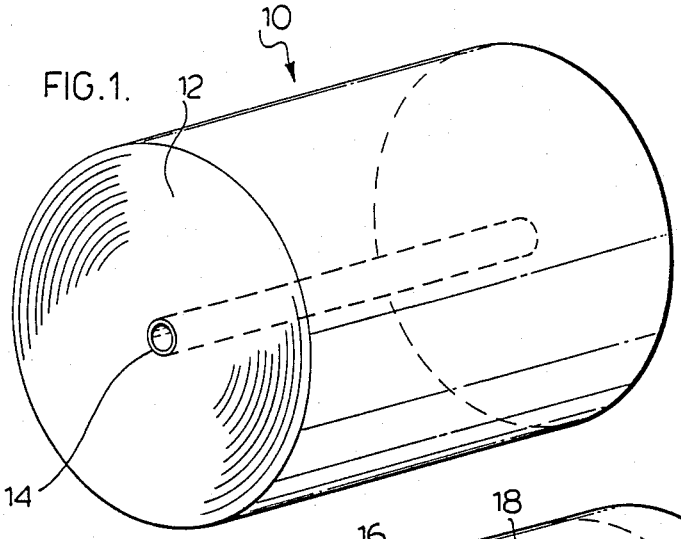

This invention relates to packaged rolls of paper or other sheet material.

In the papermaking industry, paper such as newsprint is wound on a tubular core member to produce a large roll which may for example be of the order of four feet in diameter and five feet in length and which may have a weight of about one tonne, the core member usually having an external diameter of about four inches. When such rolls are produced in a papermill, the conventional practice is to wrap a protective sheet of material (known as a wrap) around the circumference of the roll with the wrap projecting beyond each end with overlapping longitudinally-extending edge portions being secured together by adhesive. A band of sheet material is then wrapped around the circumference of the roll at each end for additional protection, the band also projecting from the end of the roll. A circular inner header of sheet material is then positioned against each end of the roll within the projecting portions of the wrap and band.

The projecting portions of the wrap and the band are then crimped radially inwardly over the outer annular portions of the ends of the roll so as to lie against the external face of the internal header at the respective ends. An external header, which may be coated with a suitable adhesive, is then positioned against the external surface of the crimped over protective sheet and band end portions and the central area of the internal header at each end of the roll and caused to adhere thereto. Alternatively, the external header may be without adhesive, in which case an annular strip of adhesive may be applied to the crimped over portions. The inner face of the external header is then caused to adhere to the crimped over portions, for example by heat and/or pressure applied by wrapping equipment.

The crimped over end portions of the wrap and band at each end of the roll extend a short distance over the end face of the roll (i.e. over an outer annular portion thereof) leaving a circular end portion of the end face covered only by the inner and outer headers. Thus, the thickness of the annular outer portion of the end covering is much thicker than the thickness of the central circular portion. also, the thickness of the outer annular portion is irregular in the circumferential direction because the crimping of the wrap and bands produces radially inwardly extending folds at spaced intervals.

Packaged rolls are usually stored and shipped in a standing-on-end orientation, and are frequently stacked one on top of the other, some times three or four high. Since eaoh roll may weigh about a tonne, the pressure on an end face in engagement with the floor or with another roll in a stack is high. Because of the lesser thickness of the end covering in the circular central area, the cushioning effect of the end covering is not particularly satisfactory for end-on-end stacking.

The prior art end covering described above evolved primarily because it used to be common practice to lift a packaged roll by means of a fork lift truck whose lifting arms were positioned under the curved surface of a roll whose curved surface engaged the ground. The prior art end covering served to protect the curved ends of the paper roll from damage which might be caused by purshing, dropping at an angle or bumping by a fork lift truck. However, nowadays it is more common for packaged rolls to be lifted by a clamp truck which has laterally-movable lifting arms which engage opposite sides of a standing-on-end roll. It is thus no longer necessary for the end covering to be designed to maximise protection for the curved ends of the roll. It would however be desireable to provide an end covering with improved cushioning for end-on-end stacking purposes.

It is therefore an object of the invention to provide an improved packaging for rolls of paper or other sheet material which provides improved cushioning over the ends of the rolls.

According to the present invention, at least one header assembly comprises a series of generally rectangular strips of material for example three, four or five strips, superposed one on top of the other in a star-like manner with central portions overlapping and scoured together, and shorter edges outermost and adjacent but within the periphery of the roll, said overlapping central portions of the header assembly strips being located within the outer annular portion of the end of the roll over which the crimped over projecting protective sheet portion extends.

Such a header assembly may be located externally and/or internally of the crimped over projecting protective sheet portion. Bands of the kind known in the prior art may or may not also be used.

The overlapping central strip portions provide thickness more consistent with the thickness of the crimped over end portions of the wrap (and band if provided) so that, when a packaged roll is stood on its end, the cushioning effect is more evenly distributed over the end face. The total thickness of the end covering in the central area is preferably substantially equal to the total thickness of the outer annular area, although the total central thickness may be greater or less than the outer annular area thickness if desired.

Advantageously, such a header assembly has four generally rectangular strips of material scoured one on top of the other in a star-like manner with central portions overlapping and secured together and shorter edges outermost and adjacent but within the periphery of the roll, each shorter edge of each strip substantially abutting a shorter edge of an adjacent strip at its ends.

Figure 2:
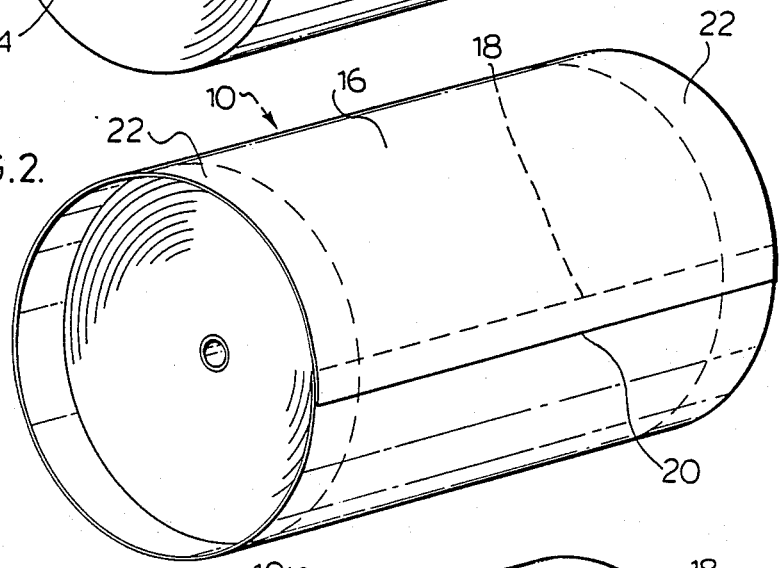
Figure 3:
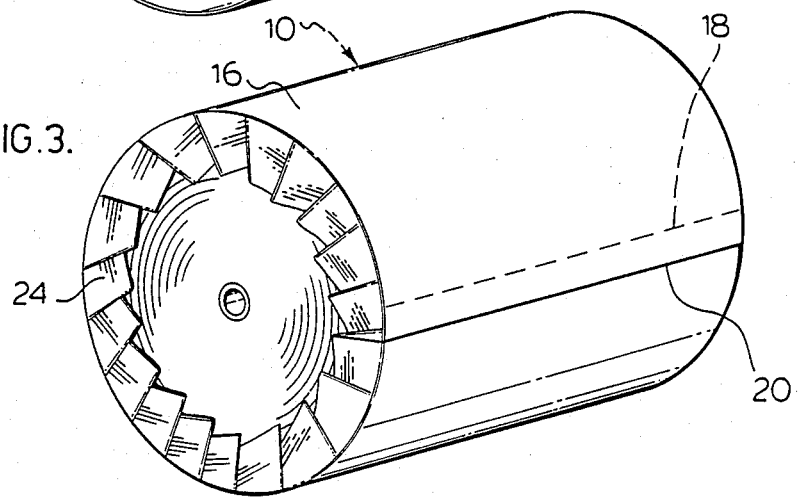
Figure 4A:
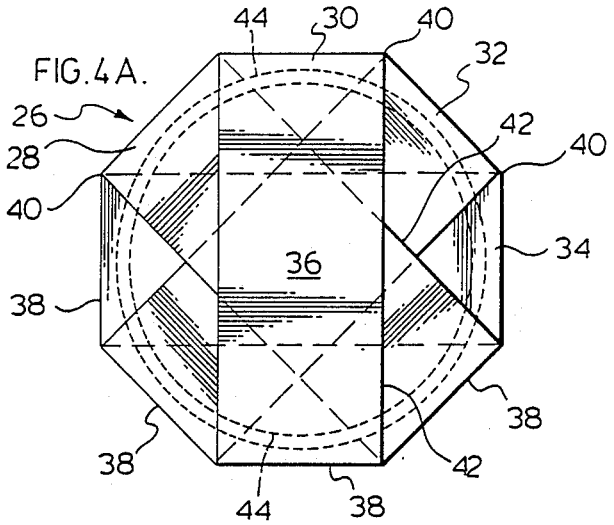
Figure 4B:
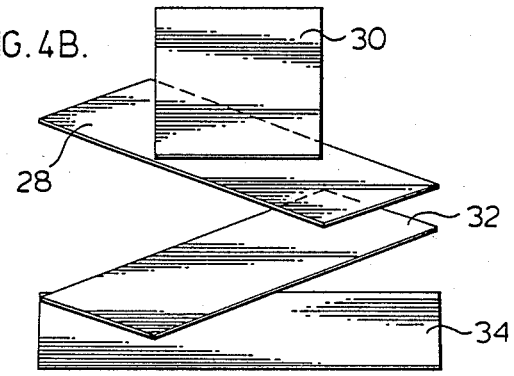
Figure 5:
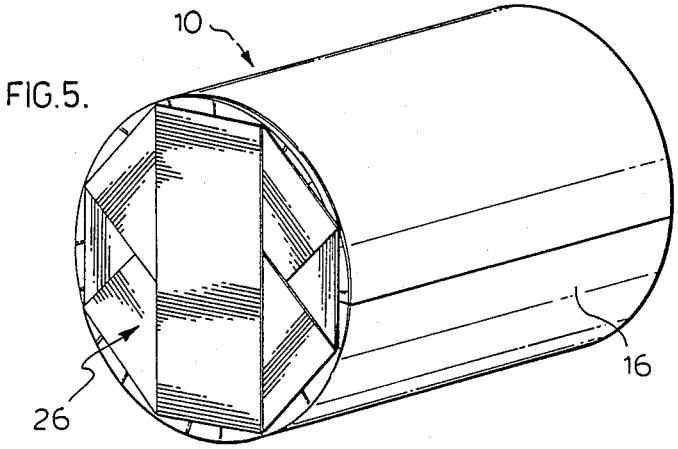
Figure 6:
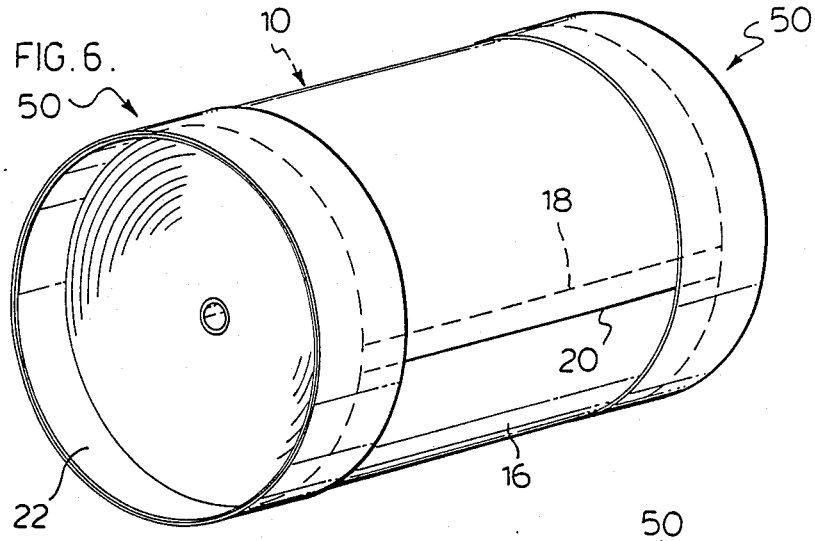
Figure 7:
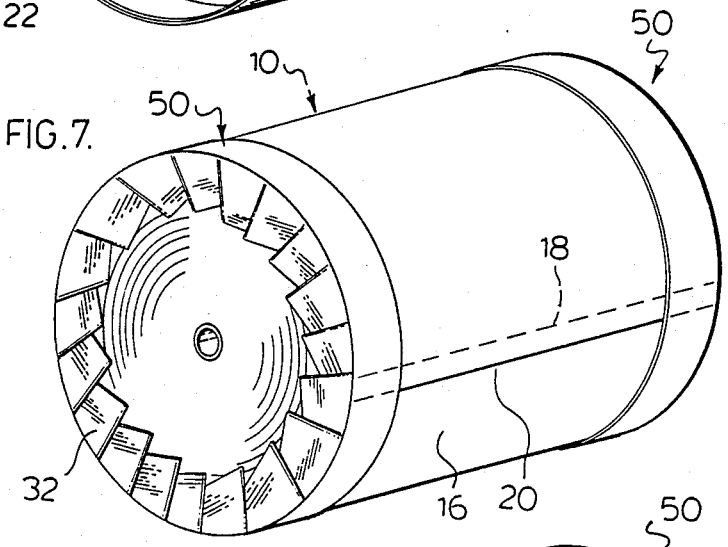
Figure 8:
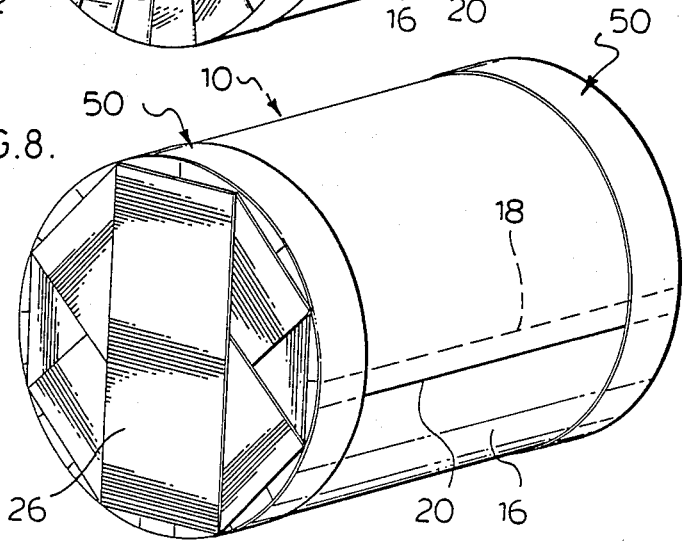
Figure 9:
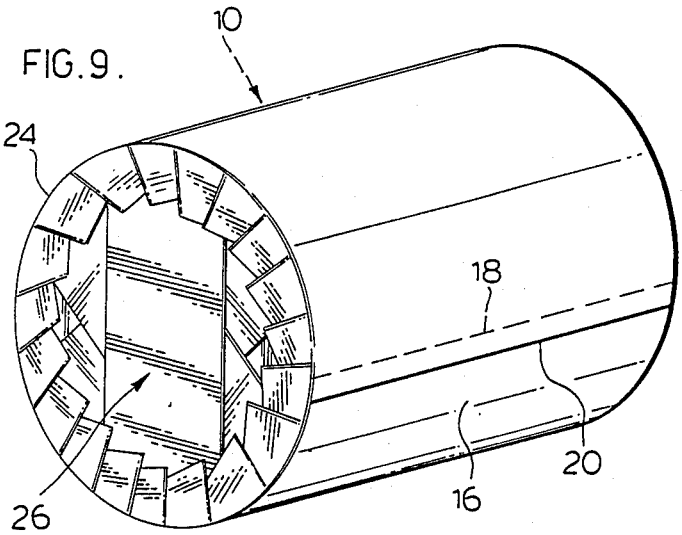
Figure 10:
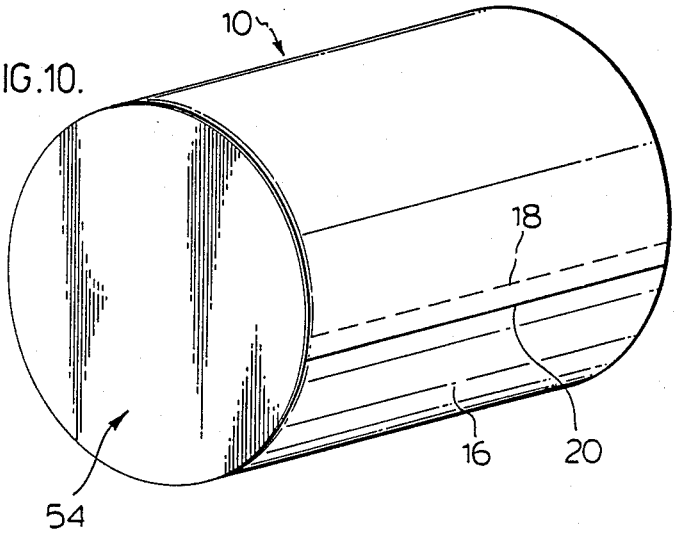
Figure 4A:
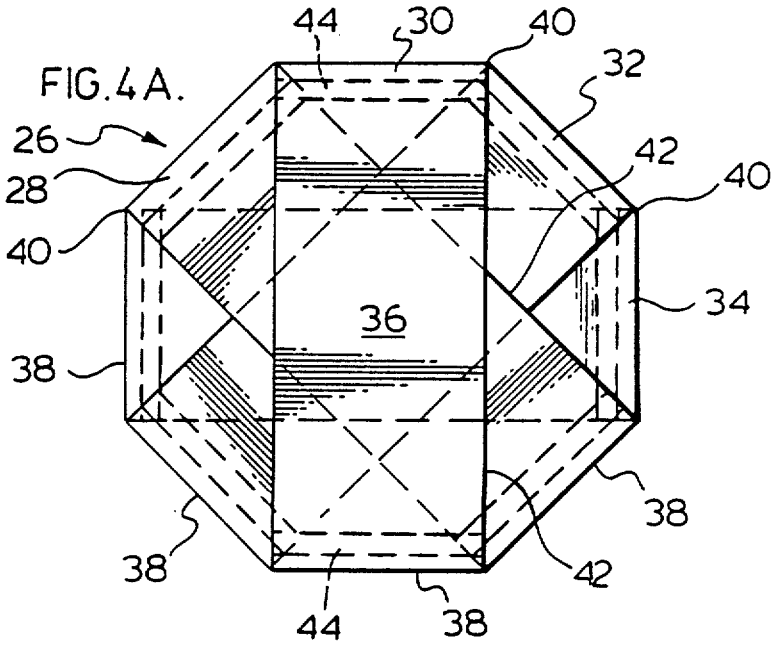
Figure 4B:
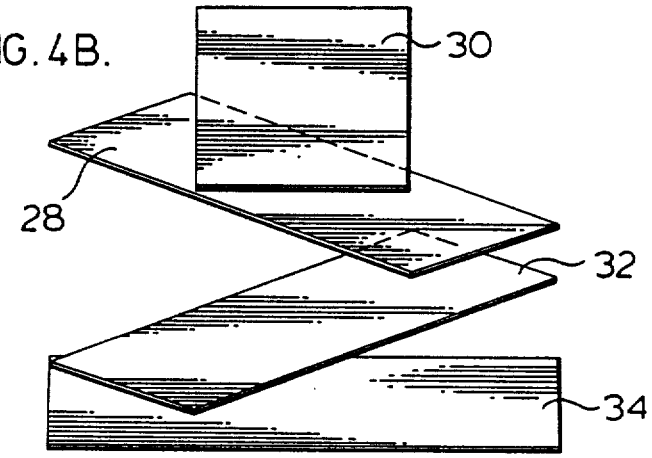
Figure 5:
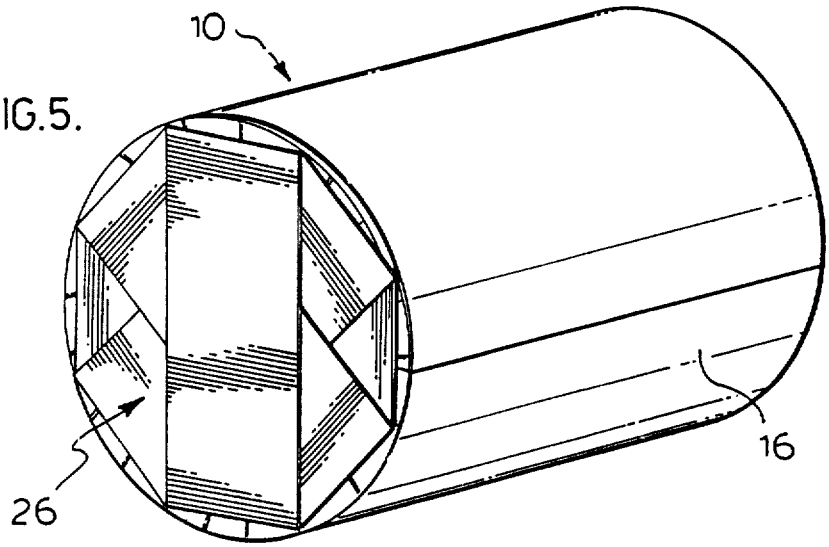

Embodiments of the invention will now be described, by way of example, with reference to the accompanying drawings, of which:

FIG. 1 is a perspective view of an unwrapped paper roll,

FIG. 2 is a similar view showing a sheet of protective material wrapped around the paper roll, FIG. 3 is a similar view showing the end portions of the protective wrap crimped radially inwardly across the ends of the roll, FIG. 4A is a front view of a header assemble in accordance with the invention, FIG. 4B is an exploded view of the header assembly, FIG. 5 is a perspective view showing the header assembly secured externally to the crimped over end portions of the protective wrap, FIG. 6 is a view similar to FIG. 2 but showing bands positioned around the ends of the protective wrap, FIG. 7 is a similar view showing the end portions of the bands and protective wrap crimped radially inwardly across the ends of the roll, FIG. 8 is a similar view showing an outer header assembly in accordance with the invention secured externally tO the crimped over end portions of the band and protective wrap, FIG. 9 is a perspective view showing the end portions of the protective wrap crimped radially inwardly across the ends of a roll with a header assembly in accordance with the invention located internally between the crimped over end portions of the wrap and the end of the roll, and FIG. 10 is a similar view showing a circular outer header of the prior art kind secured to the crimped over end portions of the wrap of FIG. 9.

Referring first to FIGS. 1 to 5 of the drawings, FIG. 1 shows an unwrapped newsprint paper roll 10 with newsprint paper 12 wound on a tubular member core 14, the roll 10 being about 42 inches in diameter, about five feet in length, and having a weight of about one tonne. The tubular core member 14 has an external diameter of about four inches.

As shown in FIG. 2, a sheet of protective material 16, which may be Kraft linerboard with a thickness of 0.015 inches, is then wrapped around the roll 10, in the same manner as in the prior art, so that the longitudinal edges 18, 20 overlap and are scoured to eaoh other by suitable adhesive. The width of the protective wrap 16 is greater than the length of the roll 10 so that the end portions 22 of the wrap 16 project beyond the ends of the roll. In this embodiment, each projecting wrap end portion 22 projects for a distance of about 4 inches. This a shorter amount than conventionally found in the prior art where the usual projecting length is about 5 to 6 inches.

The projecting end portions of the protective wrap 16 are then crimped radially inwardly in known manner as shown in FIG. 3, so as to extend over an outer annular area of the end of the roll 10 with generally radially inwardly extending fold lines 26.

FIG. 4A and 4B show a header assembly 26 in accordance with the invention and comprising four rectangular strips 28, 30, 32, 34 of Kraft linerboard with a thickness of 0.015 inches. The header strips are superposed one on top of the other in a star-like manner with central portions 36 overlapping and secured together with a suitable adhesive and with their shorter edges 38 outermost. Each end of each shorter edge 38 of each header strip abuts an end of the shorter edge 38 of an adjacent header strip so that abutting shorter edge ends form points 40 of a regular octagon, the points 40 lying on a circle whose diameter is substantially equal to (but slightly less than) the diameter of the paper roll 10. Lines of suitable heat sensitive polyethylene adhesive 44 are provided on the rear faces of the header strips near and parallel to their shorter edges 38.

In this particular embodiment, as mentioned above, the diameter of the paper roll 10 is four feet, which is therefore just slightly greater than the diameter of the circle on which the octagon points 40 lie. The length of the shorter edges 38 of the header strips is 18.36 inches, and the length of the longer edges 42 of the header strips is 44.34 inches.

A header assembly 26 in accordance with the invention is then positioned against each end of the roll 10. FIG. 5 shows only one end, but it will be understood that the operations now to be described take place at each end. It will also be understood that these operations may be carried out by automated equipment of the kind used with prior art headers consisting of a circular piece of material. Since the header strips 28, 30, 32, 34 have the dimensions referred to above, the points 40 formed by abutting ends of shorter edges 38 of the header strips are positioned just within the circumference of the roll 10.

Adhesive actuating equipment of known kind is then used to heat actuate the lines of adhesive 44 on the rear faces of the header strips at each end of the roll 10 to cause the header strips to adhere to the crimped over end portions of the wrap 16.

Since the overlapping central portions 36 of the header assembly strips lie within the outer annular area of the ends of the roll over which the crimped over end portions of the wrap extend, end coverings with improved cushioning effect are provided.

The thickness of the overlapping central portions 36 of the header assembly strips is preferably substantially equal to the thickness of the crimped over end portions of the wrap 16 plus the thickness of the outer portions of the header assembly strips, but may be of greater or less thickness if desired.

Referring now to FIGS. 6 to 8 which show a second embodiment of the invention, FIG. 6 is similar to FIG. 2 but also shows bands of sheet material 50 wrapped around opposite end portions of the protective wrap 16 in the same manner as in the prior art, so that eaoh band 50 extends beyond the end of the roll by the same amount as the protective wrap portion 22. The length of each projecting portion of the band 50 is approximately equal to the length which extends along the roll 10. Each band 50 may be of Kraft linear board of 0.015 inches thickness.

The projecting end portions of the protective wrap 16 and bands 50 are then crimped radially inwardly in known manner, as shown in FIG. 7 (which is similar to FIG. 3), so as to extend over an outer annular area of the end of the roll 10 with radially inwardly extending fold lines 52.

A header assembly 26 in accordance with the invention is then positioned against each end of the roll 10. FIG. 8 (which is similar to FIG. 5) shows only one end. Again, it will be understood that the operations now to be described take place at both ends, and that these operations may be carried out by automated equipment of known kind. Such automated equipment is used to heat actuate the lines of adhesive 44 on to cause the header strips to adhere to the crimped over end portions of the wrap 16 and bands 50.

FIGS. 9 and 10 show a third embodiment of the invention. In FIG. 9, a header assembly in accordance with the invention has been placed against each end face of the roll 10 before the projecting end portions of the protective wrap 16 were crimped over. The header assembly 16 is thus in this embodiment an internal header assembly, which is in contrast to the previous embodiments where the header assembly 26 was an external header assembly. In this case, the lines of adhesive 44 may be omitted.

The end covering is completed, as shown in FIG. 10, by applying a circular header 54 of prior art kind as an outer header at each end of the roll 10. An annular stripe (not shown) of heat sensitive polyethylene is applied to the crimped over end portions of the wrap 16, and the circular header 54 is caused to adhere thereto by use of known adhesive actuating equipment.

The advantages of the invention will be readily apparent to a person skilled in the art from the foregoing description of preferred embodiments. Besides providing improved cushioning over the ends of the roles and hence better stacking capability, an end cover in accordance with the invention is less likely to permit the radially inwardly extending fold lines 24 or 52 of the crimped over end portions of the protective wrap 16 and bands 50 (if provided) to cause indentations in the edges of the paper in the roll, as was the case with prior art end coverings, since an end covering in accordance with the present invention causes the weight of the roll to be more evently distributed over the end face or butt end of the roll when the roll is stood on its end. Also, with the present invention, the central portion of the roll is more adequately supported when the roll is stood on its end.

Furthermore, in some cases, the amount of material required for the end covering may be substantially less than with prior art end coverings, thereby producing significant cost saving. Also, because it is only necessary to provide lines of adhesive on the header assembly in accordance with the invention, the wrap 16, bands 50 (if provided) and header assemblies may be readily recycled after removal from the roll 10, thereby providing an environmental advantage.

Other advantages and embodiments will also be readily apparent to a person skilled in the art, the scope of the invention being defined in the appended claims.

I claim:

1. A packaged roll of paper or other sheet material comprising:

a roll of paper or other sheet material, a protective sheet of material wrapped around the circumference of the roll and having overlapping longitudinally-extending edge portions secured together, said protective sheet extending beyond the roll at opposite ends thereof to provide projecting protective sheet portions, the projecting portion of the protective sheet at each end being crimped radially inwardly over the outer annular portion of the end of the roll, and at least one header assembly at each end of the roll located externally and/or internally of the crimped over projecting protective sheet portion, at least one header assembly comprising a series of generally rectangular strips of material superposed one on top of the other in a star-like manner with central portions overlapping and secured together and shorter edges outermost and adjacent but within the periphery of the roll, said overlapping central portions of the header assembly strips being located within the outer annular portion of the end of the roll over which the crimped over projecting protective sheet portion extends.

2. A packaged roll according to claim 1 wherein a band of sheet material is wrapped around the protective sheet at least one end of the roll so as to have a portion extending partially over a respective end portion of the roll and a portion projecting from the roll and surrounding the projecting protective sheet portion, both the projecting portion of the protective sheet and the projecting portion of the band being crimped radially inwardly over the outer annular portion of the end of the poll.

3. A packaged roll according to claim 1 wherein each said header assembly comprising a series of superposed strips has four generally rectangular strips of material secured one on top of the other in a star-like manner with central portions overlapping and secured together and with shorter edges outermost and adjacent but within the periphery of the roll, each shorter edge of each strip substantially abutting a shorter edge of an adjacent strip at its ends.

4. A packaged roll according to claim 1 wherein a band of sheet material is wrapped around the protective sheet at at least one end of the roll so as to have a portion extending partially over a respective end portion of the roll and a portion projecting from the roll and surrounding the projecting protective sheet portion, both the projecting portion of the protective sheet and the projecting portion of the band being crimped radially inwardly over the outer annular portion of the end of the roll, and eaoh said header assembly comprising a series of superposed strips having four generally rectangular strips of material secured one on top of the other in a star-like manner with central portions overlapping and secured together and with shorter edges outermost and adjacent but within the periphery of the roll, each shorter edge of each strip abutting a shorter edge of an adjacent strip at its ends.

5. A packaged roll according to claim 1 wherein a said header assembly comprising a series of superposed strips is located externally of the crimped over projecting protective sheet portion at at least one end of the roll.

6. A packaged roll according to claim 1 wherein a said header assembly comprising a series of superposed strips is located internally of the crimped over projecting protective sheet portion at at least one end of the roll.

* * * * *

UNITED STATES PATENT AND TRADEMARK OFFICE

CERTIFICATE OF CORRECTION

PATENT NO. : 4,858,762

DATED : August 22, 1989

INVENTOR(S) : Daniel D. Kewin

It is certified that error appears in the above-identified patent and that said Letters Patent is hereby corrected as shown below:

The sheet of drawing consisting of figs. 4A, 4B and 5 should be deleted to appear as per attached sheet.

Signed and Sealed this

Thirtieth Day of October, 1990

*Attest:*

HARRY F. MANBECK, JR.

*Attesting Officer*

*Commissioner of Patents and Trademarks*